United States Patent [19]

Schwartzman

[11] Patent Number: 4,637,549

[45] Date of Patent: Jan. 20, 1987

[54] ROTATION SPEED CONTROL DEVICE FOR A ROTARY, IMPULSE WATER SPRINKLER AND A WATER SPRINKLER HAVING SAME

[76] Inventor: Joel Schwartzman, 47 James Dr., Ringwood, N.J. 07456

[21] Appl. No.: 729,067

[22] Filed: Apr. 30, 1985

[51] Int. Cl.[4] ..... B05B 3/04

[52] U.S. Cl. ..... 239/230; 239/232; 239/236; 239/DIG. 1

[58] Field of Search ..... 239/DIG. 1, 222.15, 239/231, 232, 233, 252, 255, 256, 260, 265, 505, 507, 515, 97, 514, 513, 230, 236, 264

[56] References Cited

U.S. PATENT DOCUMENTS

| | | | |
|---|---|---|---|
| 2,565,926 | 8/1951 | Manning | 239/DIG. 1 X |
| 2,619,383 | 11/1952 | Jypson | 239/231 |
| 2,654,635 | 10/1953 | Lazzarini | 239/230 |
| 2,877,053 | 3/1959 | Kennard | 239/233 |
| 2,999,645 | 9/1961 | Kennedy | 239/231 X |
| 3,391,868 | 7/1968 | Cooney | 239/232 |
| 3,878,990 | 4/1975 | Gerandie | 239/DIG. 1 X |
| 3,960,327 | 6/1976 | Olson | 239/236 |

FOREIGN PATENT DOCUMENTS

| | | | |
|---|---|---|---|
| 2405621 | 6/1979 | France | 239/DIG. 1 |
| 92066 | 7/1958 | Norway | 239/230 |

*Primary Examiner*—Andres Kashnikow
*Assistant Examiner*—Kevin Patrick Weldon
*Attorney, Agent, or Firm*—Harry B. O'Donnell, III

[57] ABSTRACT

A rotary, impulse water sprinkler having a rotatable water dispensing head includes a water nozzle for directing a stream of water with a movable splash plate extending over the outlet of the nozzle to selectively deflect the water stream issuing from the nozzle to control the distance that the water stream will project from the water nozzle outlet. The impulse water sprinkler has a pivotally mounted impulse device with a vane at one end thereof adapted to be selectively disposed in the water stream from the nozzle outlet thereby causing the dispensing head to rotate. A rotation speed control device is operatively associated with the impulse device to control the amount by which the impulse vane is disposed within the water stream.

7 Claims, 4 Drawing Figures

ROTATION SPEED CONTROL DEVICE FOR A ROTARY, IMPULSE WATER SPRINKLER AND A WATER SPRINKLER HAVING SAME

BACKGROUND OF THE INVENTION

1. Field of the Invention

The invention relates to water dispensing devices, and more particularly to lawn watering or sprinkling devices of the impulse type.

2. Description of the Prior Art

It has long been a problem in the use of lawn sprinklers to provide a pattern which will place the water only where it is needed.

Rotating sprinklers operate either under the force of an impulse device or the head rotates under the reaction of the exhaust of the water being dispensed. Because rotating sprinkler apparatus produce circular patterns and since most property boundaries are not circular, there are usually situations where it is necessary to spray large quantities of water onto areas where water is not desired, such as walkways and streets, in order to cover the desired areas with water. One alternative is to spray less than all of the desired area and to use soaking strips or hand water the areas missed by the sprinkler device. Another alternative is to move the sprinkler device to different locations within the area to be water until the entire area is watered. This procedure requires readjustment of the water pressure supplied to the sprinkler device for each location and causes overlapping areas already sprayed which results in uneven water distribution over the entire area to be watered. In in-the-ground sprinkler installations, the requirement of limiting the sprinkling to a defined area requires the installation of many individual spraying devices which increases the cost of such in-the-ground systems.

Many attempts have been made in the past to provide some sort of apparatus which could alter the dispersal of water from a circular arc perimeter pattern and to also maintain a uniform watering density by controlling the water discharge rate. Several examples of these attempts are shown in the following U.S. Pat. Nos.

1,593,918 to Stanton;
2,421,551 to Dunham;
2,565,926 to Manning;
2,582,158 to Porter;
2,962,220 to Woods;
2,999,645 to Kennedy;
3,033,469 to Green;
3,070,314 to Warren;
3,070,315 to Landry;
3,081,039 to Kennedy;
3,082,958 to Thomas;
3,204,874 to Senninger;
3,606,163 to Lewis; and
4,277,029 to Rabitsch.

However, none of these patents teach camming surfaces which are easily adjustable to provide for variation of the spray pattern for dispensing water onto or over any shaped area.

My copending U.S. patent application Ser. No. 557,734, filed on Dec. 2, 1983, solves this drawback, among others, of the heretofore known sprinklers.

A further problem with heretofore known sprinkler devices is that they rotate at a constant speed and dispense a constant volume rate of flow of water as they rotate. The result is that, of course, the further the zone to be watered is from the sprinkler device, the larger is the geometric area to which the water is to be applied. The result is that area to be watered furthest from the sprinkler device will receive a lesser amount of water per unit area than will smaller, closer-in areas.

Another problem with heretofore known sprinkler devices is that they do not provide for maintaining a desired or uniform watering density as the pattern of the area to be watered changes because the area changes as a function of the distance from the sprinkler device.

One attempt to overcome this drawback in rotary reaction type sprinkler devices is shown in U.S. Pat. No. 3,979,066 issued on Sept. 7, 1976 to Fortner. However, the device of Fortner can only be used on reaction type sprinkler devices. Further, in the device of Fortner the rotational speed of a reaction sprinkler to one and only one speed must be set the start of a sprinkling event, and can be not be used to provide continuous changing rotational speeds during each cycle of the sprinkler device. Even further, the device of Fortner is useable only on sprinkler devices which rotate in one direction, but is not capable of functioning on oscillatory sprinkler devices.

The present invention recognizes the drawbacks of the sprinkler devices heretofore known to me and provides a solution which is straightforward and easy to maintain in operation.

SUMMARY OF THE INVENTION

It is an object of the present invention to provide a bidirectional rotational speed control for a rotary water sprinkler which is adapted to allow for continuously changing the rotational speed of the sprinkler during each cycle of the sprinkler device.

It is another object of the present invention to provide a speed control of the class described which is used on oscillatory, rotational sprinkler devices.

It is yet another object of the present invention to provide a speed control device for use with an impulse type water sprinkler for selectively presetting the rate of change of the rotational speed of the impulse type water sprinkler.

It is still further an object of the present invention to provide a rotational speed control for an impulse type lawn sprinkler having means for varying the water dispensing pattern which causes the rotational speed of the sprinkler to change in conjunction with the changing water dispersing pattern.

It is yet a further object of the present invention to provide a rotational speed control device for an impulse type lawn sprinkler which functions externally of the water flow passages within the sprinkler to eliminate the possibility of clogging of the water flow passages and accomplish bidirectional motion to the sprinkler.

More particularly, the present invention provides a water sprinkler apparatus comprising a dispensing head adapted for rotational movement; a water dispensing nozzle associated with the dispensing head for dispensing a stream of water; movable impulse means associated with the dispensing head and adapted to be at least partially located in the dispensed stream of water from the dispensing nozzle for imparting an impulse force to the dispensing head to rotation the dispensing head as water issues from the dispensing nozzle; movable baffle means associated with the dispensing head adapted to selectively move into and out of the path of water from the dispensing nozzle to deflect the stream of water; baffle control means for selectively moving the baffle means into and out of the path of water from the nozzle as the dispensing head rotates; speed control means operatively associated with the baffle means and impulse means for selectively limiting movement of the impulse means into the path of water from the nozzle as a function of the position of the baffle means relative to the path of water from the nozzle.

The present invention also provides a rotational speed control adapted for use with a rotary water sprinkler apparatus of the impulse type having a pivotal impulse device including an impulse vane disposed at the water outlet nozzle and adapted to be at least partially located in the path of a water stream issuing from the outlet nozzle wherein water from the outlet nozzle will impact the impulse vane to impart rotary motion to the sprinkler, the speed control comprising means operatively associated with the impulse device for selectively controlling the amount by which the impulse vane is located in the path of water issuing from the outlet nozzle of the sprinkler.

BRIEF DESCRIPTION OF THE DRAWINGS

These and other objects and advantages of the present invention will become even more clear upon reference to the following description of the preferred embodiment in conjunction with the accompanying drawings wherein like numerals refer to like parts throughout the several views and in which.

DETAILED DESCRIPTION OF THE PREFERRED EMBODIMENT

Figure 1:
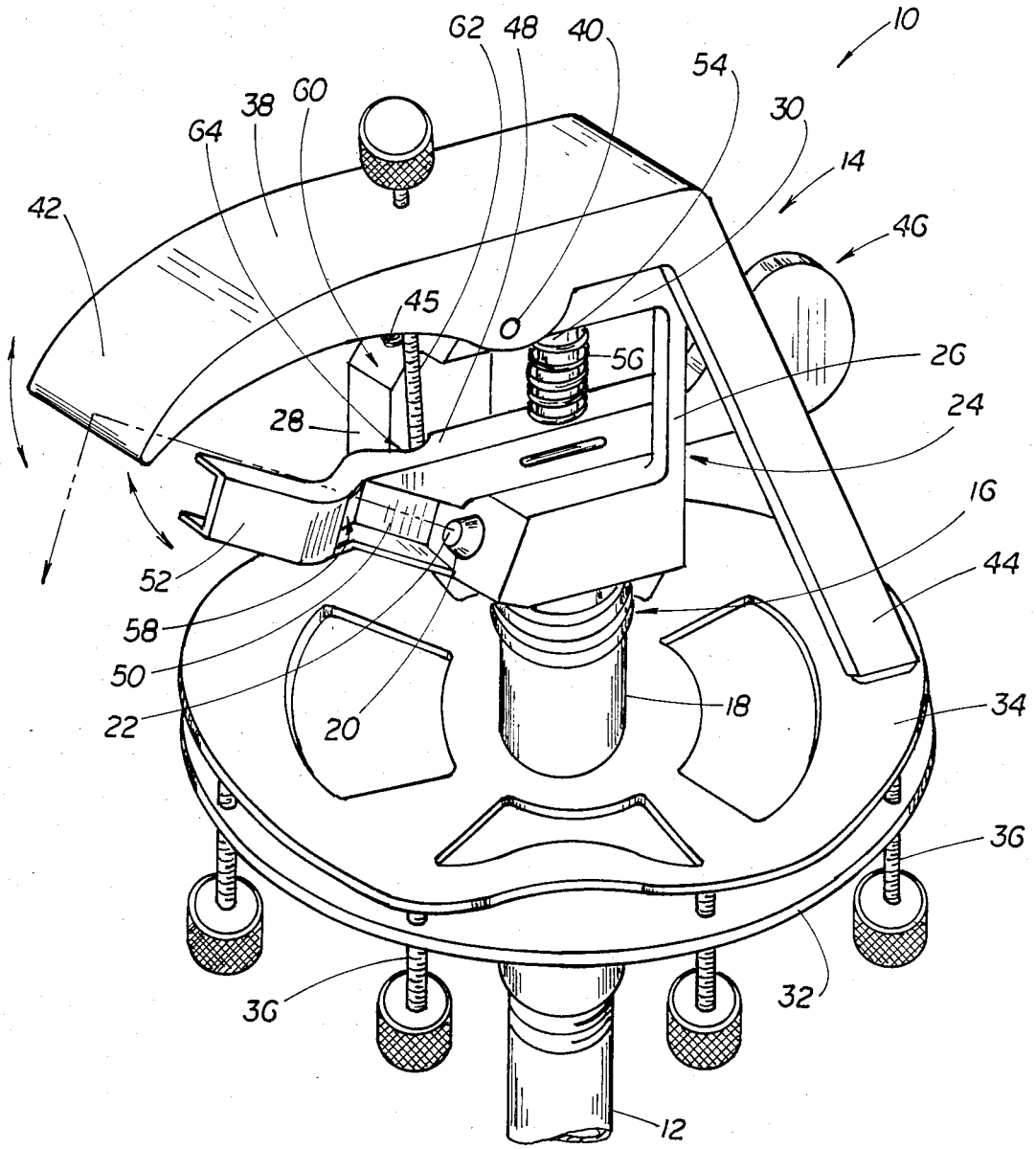
FIG. 1 is a perspective view showing an impulse type sprinkler having a device for controlling the water dispensing pattern, and incorporating the speed control feature of the present invention.
Figure 2:
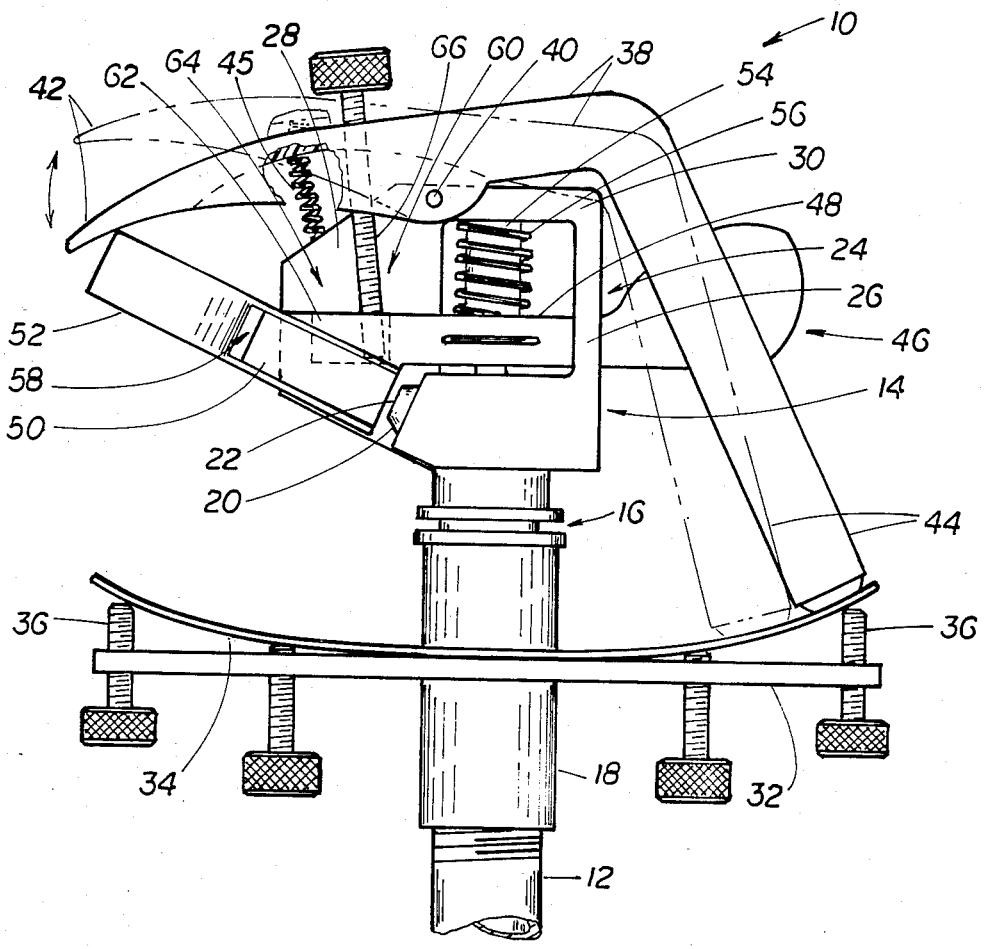
FIG. 2 is an enlarged side view of the sprinkler of FIG. 1 with portions broken away to show details of the present invention.

Referring to FIGS. 1 and 2, there is shown a water dispensing apparatus generally indicated as 10, having a water supply pipe 12 which carries water up to a dispensing head generally indicated as 14. The dispensing head 14 is rotatably connected to the top end of the supply pipe 12 by means of a swivel joint 16 of the type well known in the art so that the dispensing head can rotate, for example, in a plane perpendicular to the axis of the water supply pipe 12. Most usually, the water dispensing apparatus 10 is oriented so that the dispensing head 14 will rotate in a generally horizontal plane.

The dispensing head 14 includes a depending water delivery pipe 18 axially aligned with and interconnected to the water supply pipe 12 by means of the swivel joint 16. A water dispensing nozzle 20 is in water flow communication with the delivery pipe 18 and extends therefrom at an acute angle to the horizontal terminating at water outlet aperture 22. As shown, the dispensing head 14 also includes a frame structure 24 generally located over the nozzle 20 which has a rear upwardly extending leg 26, a front upwardly extending plate 28 located laterally of the nozzle 20 and a top plate 30 spanning the distance between and interconnecting the top ends of the rear leg 24 and front plate 30. Preferably, the rear leg 26, front plate 28 and top plate 30 are integrally formed. The top plate 30 includes a generally horizontal section extending from the top end of the rear leg 24 toward the front plate 30, and a declined section slanting downwardly from the terminal end of the horizontal section to the top end of the front plate 30.

A stationary circular, planar cam support plate 32 is concentrically located with the water supply pipe 12 and fixedly attached to the water supply pipe 12. A flexible cam surface 34, generally circular in peripheral shape, is located over the top surface of the cam support plate 32. The flexible cam surface 34 is fabricated of a flexible material such as, for example, a thin sheet of plastic. The cam surface 34 is flexible so that the cam development can be selectively changed. As shown, the cam development of the cam surface 34 can be selectively changed by means of a plurality of set screws 36 threaded upwardly through appropriate threaded apertures in the cam support plate 32. The set screws 36 are arranged in a circular array concentric with the axis of the water supply pipe 12 such that the upwardly extending ends of the set screws 36 contacts the underside of the flexible cam surface 34. Thus, the cam development of the cam surface 34 can be selectively changed by threading these set screws 36 upwardly and downwardly, thus, bending the cam surface 34 to form a desired cam development.

A movable, elongated splash plate 38 is located over the top plate 30 of the frame structure 24 and is mounted to the top plate 30 by a pivot pin 40. The splash plate 30 terminates at a front or splash end 42 which is located above and in front of the outlet aperture 22 of the nozzle 20. The front, splash end 42 of the splash plate 38 functions as a splash baffle for selectively deflecting water issuing from the nozzle aperture 22 as dictated by the cam development of the cam surface 34. Toward this objective, the end section of the splash plate 38 opposite the splash plate end 42 depends toward the cam surface 34 and terminates at a cam follower end 44 in contact with the cam surface 34. The splash plate 38 is biased to rotate about the pivot pin 40 in a direction holding the cam follower end 44 in contact with the cam surface 34 by means of a spring 45 located between the underside of the splash plate 38 and upper side of the top plate 30 of the frame structure 24.

Figure 3:
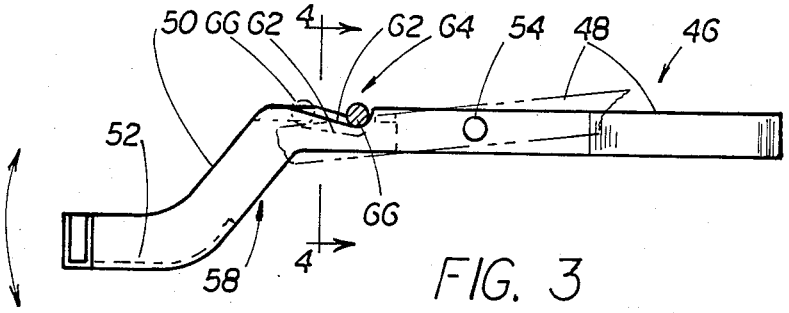
FIG. 3 is a plan view of the components of the present invention removed from the sprinkler; and, FIG. 4 is a transverse cross-sectional view as seen in the direction of arrows 4—4 in FIG. 3.
Figure 4:
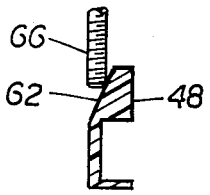

With continued reference to FIGS. 1 and 2 and additional references to FIG. 3, the dispensing head 14 is caused to rotate about the swivel joint 16 interconnecting the water supply pipe 12 and water delivery pipe 18 of the dispensing head 14 by means of an impulse device, generally denoted as the numeral 46, commonly referred to as a clapper in the industry. As shown, the impulse device 46 includes a bar section 48 having impulse vanes 50 and 52 located at one end. The impulse device 46 is located on the dispensing head 14 with the bar section 48 generally perpendicular to the axis of rotation of the dispensing head, and with the impulse vanes 50 and 52 located generally in front of the nozzle aperture 22. The impulse device 46 is pivotally mounted between its ends, to the dispensing head 14 for oscillatory movement in a plane perpendicular to the axes of rotation of the dispensing head. Toward this end, the bar section 48 is formed with an aperture generally perpendicular to the longitudinal axes of the bar section. The dispensing head 14 includes an upwardly extending bearing pin 54 generally coaxial with the swivel joint 16. The bearing pin 54 is received through the aperture in the bar section 48 with a bearing fit so that the impulse device 46 will pivot about the bearing pin 54. Further, a coil spring 56 is concentrically located over the length of the bearing pin 54 projecting through aperture in the bar section 48. As illustrated, one end of the coil spring 56 is fixed to the top plate 30 of the frame structure 24 and the other end of the coil spring 56 is fixed to the bar section 48 of the impulse device 46 to bias the impulse device 46 about the bearing pin 54 in a direction to move the impulse vanes 50 and 52 toward a position in front of the nozzle. aperture 22. The first impulse vane 50 is located upstream, relative to the water issuing from the nozzle aperture 22, from the second impulse vane 52, and the concave reaction surfaces of the first and second vanes 50 and 52 generally face each other. In addition, the first and second impulse vanes 50 and 52 are laterally spaced apart from each other providing a water path or window 58 between the downstream end of the upstream or first impulse vane 50 and the upstream end of the downstream or second impulse vanes 52.

In operation of the water dispensing apparatus 10, the splash plate 38 functions under the influence of the cam surface 34 to change the distance by which water issuing from the nozzle aperture 22 will be projected. The cam surface 34 is adjusted by the set screws 36 to form high and low sections, as selected by a user of the dispensing apparatus 10, to provide a desired spray pattern. As the cam follower end 44 of the splash plate 38 traverses a high development of the cam surface 34, the splash plate 38 is forced to pivot about its pivot pin 40 in a direction to force the front or splash baffle end 42 downwardly into the water stream issuing from the nozzle aperture 22 deflecting the water stream downwardly, thus, shortening the distance by which the water stream will be projected. As the cam follower end 44 of the splash plate 38 traverses a low development of the cam surface 34, the splash plate 38 is forced to pivot about the pivot pin 40 in the opposite direction under the biasing influence of the spring 45 to force the front or splash baffle end 42 upwardly away from the water stream issuing from the nozzle aperture 22, thus, lengthening the distance by which the water stream will be projected.

It is desirable to control the rotational velocity of the dispensing head 14 of a water dispensing apparatus to control the amount of water being applied to a given area. Toward this objective and with reference to FIGS. 1–4, the impulse device 46 incorporates a rotational speed control device, generally denoted as the numeral 60. The speed control device 60 comprises a cam follower surface 62 shown as being defined by the edge of a notch 64 formed on one side of the bar section 48 of the impulse device 46 to the convex side of the first impulse vane 50 proximate the first or upstream impulse vane 50, and cam means including a cam follower push rod 66 attached to and depending from the splash plate 38 and projecting into the notch 64 in contact with the cam follower edge 62 of the notch 64. The cam follower defining notch 64 and cam follower push rod 66 are located toward the deflection baffle end 42 of the splash plate 38 from the location of pivot pin 40 connecting the splash plate 38 to the frame structure 24. Thus, the push rod 66 will move in the notch 64 in a direction upwardly and generally away from the end of the impulse device bar section 48 having the impulse vanes 50 and 52 in a generally arcuate path along the longitudinal axis of the bar section 48 when the splash plate 38 is caused to pivot in a direction about its pivot pin 40 to move the baffle splash end 42 downwardly into the water stream issuing from the nozzle aperture 22. Conversely, the push rod 66 will move in the notch 64 in a direction downwardly and generally toward the end of the impulse device bar section 48 having the impulse vanes 50 and 52 in a generally arcuate path along the longitudinal axis of the bar section 48 when the splash plate 38 is caused to pivot in a direction about its pivot pin 40 to move the baffle splash end 42 upwardly in a direction outward from the water stream issuing from the nozzle aperture 22. The cam follower defining notch 64 is shown, for the sake of illustration, as being somewhat teardrop shaped in plan view. That is, the notch 64 angles from a shallow end proximate the impulse vanes 50 and 52 to a deep end away from the impulse vanes 50 and 52 so that the notch face defining the cam follower surface 62 is disposed at an acute angle to the longitudinal axis of the bar section 48 of the impulse device 46. However, it should be clearly understood that other notch 64 plan view shapes can be used as may be desired. Preferably, the cam follower push rod 66 has a threaded cylindrical body and is attached to the splash plate 38 by being threadably engaged in an appropriate threaded aperture in the splash plate 38. Thus, the length of push rod 66 projecting into the notch 64 can be changed. The cam follower surface 62 defined by the notch 64 is also sloped transversely to the bar section 48 of the impulse device 46 to form an inclined plane cam follower contact surface. This feature allows the rate of change of the rotational speed of the dispensing head 14 to be selectively changed by screwing the push rod 66 further into or out of the notch 64.

The speed of rotation of the dispensing head 14 is a function of the energy imparted to the impulse device 46 by the water issuing from the nozzle aperture 22. This energy change is, in turn, a function of the distance by which the first impulse vane 50 projects into the water stream. The more vane 50 is allowed to project into the water stream the higher the energy will be resulting in a faster rotational speed of the dispensing head 14. Conversely the lesser the amount by which the first vane 50 projects into the water stream, the lower the momentum change will be resulting in a slower rotational speed of the dispensing head 14. In operation of the present invention, the interaction of the cam follower path rod 66 and cam follower surface 62 will control the distance by which the first impulse vane 50 of the impulse device 46 will project into the water stream from the nozzle aperture 22. As the cam follower push rod 66 moves in the notch 64 along the cam follower defining surface 62 toward the deep end of the notch 64, the greater the distance the first impulse vane 50 will be allowed to move into water stream under the biasing influence of the spring 56. Conversely, as the cam follower push rod 66 moves in the notch 64 along the cam follower defining edges 62 thereof in the opposite direction toward the shallow end of the notch 64, the lesser the distance the first impulse vane 50 will be allowed to move into the water stream under the influence of the spring 56. The cam follower push rod 66 can be threaded toward or away from the inclined cam follower contact surface 62 so that the free bottom end of the cam follower push rod 66 will contact a selected located along the slope of the inclined cam follower contact surface, thus, providing for an adjustment of the distance by which first impulse vane 50 will be allowed to move into the water stream as the push rod 66 moves along the cam follower contact surface 62. As can be visualized, as the cam follower push rod 66 is threaded toward the inclined cam follower surface 62, the farther down the inclined surface will be the point of contact between the free end of the push rod 66 and the inclined cam follower surface 62 with the result that the distance by which the first impulse vane 50 will be allowed to move into the water stream will be lessened. Of course, as the cam follower push rod 66 is threaded away from the inclined cam follower surface 62, the farther up the inclined surface will be the point of contact between the free end of the push rod 66 and the inclined cam follower surface 62 with result that the distance by which the first impulse vane 50 will be allowed to move into the water stream will be increased.

From the foregoing discussion, it will be appreciated that, as the splash baffle end 42 of the splash plate 38 is moved upwardly in a direction outwardly of the water stream to provide for a lengthened distance by which the water is projected, the cam follower push rod 66 will be moved in the notch 64 toward the shallow end of the notch 64, thus, automatically slowing the rotational speed of the dispensing head 14 about the swivel joint 16. Conversely, as the splash baffle end 42 of the splash plate 38 is moved further downwardly into the water stream to provide for a shortening of the distance by which the water is projected, the cam follower push rod 66 will be moved in the notch 64 toward the deep end of the notch 64, thus, automatically increasing the rotational speed of the dispensing head 14 about the swivel joint 16.

The foregoing detailed description is given primarily for clearness of understanding and no unnecessary limitations should be understood therefrom for modifications can be made by those skilled in the art upon reading this disclosure and may be made without departing from the scope of the invention or scope of the appended claims.

What is claimed is:

1. A water sprinkler apparatus comprising:

(a) a dispensing head adapted for rotational movement;

(b) at least one water dispensing nozzle associated with the dispensing head for dispensing a stream of water;

(c) speed control means for varying the rotational speed of the dispensing head as the dispensing head rotates;

(d) movable impulse means associated with the dispensing head and adapted to be at least partially located in the path of a stream of water dispensed from the dispensing nozzle for imparting an impulse force to the dispensing head to rotate the dispensing head as water issues from the dispensing nozzle; and (e) movable baffle means associated with the dispensing head and adapted to selectively move into and out of the path of water from the dispensing nozzle to deflect the stream of water, (f) said speed control means being operatively associated with said baffle means and impulse means for selectively limiting movement of said impulse means into the path of water from the nozzle as a function of the position of said baffle means relative to the path of water from the nozzle.

2. The water sprinkler apparatus of claim 1, wherein the speed control means comprises:

(a) a cam follower surface associated with said impulse means; and, (b) a cam push rod operatively associated with the cam follower surface of said impulse means to move along the cam follower surface as said baffle means moves.

3. The water sprinkler apparatus of claim 2, wherein:

(a) said movable baffle means comprises a splash plate pivotally attached to the dispensing head and having a baffle at one end of the splash plate, the baffle end of the splash plate being adapted to move into the path of water from the dispensing nozzle as the splash plate pivots in one direction and out of the path of water from the dispensing nozzle as the splash plate pivots in the other direction; and (b) the cam push rod extends from the splash plate between the baffle end of the splash plate and the pivotal attachment of the splash plate.

4. The water sprinkler apparatus of claim 3, wherein:

(a) said movable impulse means comprises a bar section pivotally attached to the dispensing head and having impulse vane means at one end, said impulse vane means being adapted to selectively move into the path of water from the dispensing nozzle as the bar section pivots in one direction and out of the path of water from the dispensing nozzle as the bar section pivots in the other direction; and (b) the cam follower surface is located on the bar section between said impulse vane means and the pivotal attachment of the bar section of said impulse means.

5. The water sprinkler apparatus of claim 4, wherein:

(a) the cam follower surface is further inclined at an acute angle to the longitudinal axis of the cam push rod; and (b) the cam push rod is longitudinally adjustable to selectively contact the cam follower surface at different selected locations along the incline of the cam follower surface.

6. The water sprinkler of claim 1, further comprising:

(a) a cam surface disposed around the axis of rotation of the dispensing head; and (b) cam follower means operatively associated with said movable baffle means and the cam surface around the axes of rotation of the dispensing head for moving said baffle means into and out of the path of water issuing from the nozzle as a function of the cam development of the cam surface.

7. A water sprinkler apparatus comprising:

(a) a dispensing head adapted for rotational movement, (b) a water dispensing nozzle associated with the dispensing head;

(c) impulse means associated with the dispensing head and adapted to be impacted by a stream of water dispensing from the dispensing nozzle for imparting an impulse force to the dispensing head to rotate the dispensing head;

(d) movable baffle means associated with the dispensing head and adapted to selectively move into and out of the path of the stream of water from the dispensing nozzle to deflect the stream of water and thereby respectively reduce and increase the projecting distance of the stream of water from the nozzle;

(e) baffle control means for selectively moving the baffle means into and out of the path of the stream of water from the nozzle as the dispensing head rotates; and (f) speed control means for varying the rotational speed of the dispensing head as the dispensing head rotates;

(g) said speed control means being operatively associated with said baffle means and impulse means for increasing and decreasing the impulse force imparted to the impulse means as a function of the position of said baffle means relative to the path of the stream of water from the nozzle so as to vary the speed of rotation of the dispensing head as an inverse function of the projecting distance of the water stream from the nozzle.

* * * * *